United States Patent [19]

Little

[11] 4,184,705

[45] Jan. 22, 1980

[54] HOOD LATCH

[75] Inventor: Carl H. Little, Jamestown, N.Y.

[73] Assignee: Weber-Knapp Company, Jamestown, N.Y.

[21] Appl. No.: 916,133

[22] Filed: Jun. 16, 1978

[51] Int. Cl.[2] ..... E05C 5/04

[52] U.S. Cl. ..... 292/247

[58] Field of Search ..... 292/247, 113, 256.75, 292/DIG. 49, DIG. 14

[56] References Cited

U.S. PATENT DOCUMENTS

| | | | |
|---|---|---|---|
| 2,349,486 | 5/1944 | Crosman | 292/247 X |
| 2,867,863 | 1/1959 | Webb et al. | 292/247 X |
| 3,628,817 | 12/1971 | Sheahan et al. | 292/247 |
| 3,825,053 | 7/1974 | Romberg | 292/247 |
| 3,892,434 | 7/1975 | Caldwell | 292/247 |

FOREIGN PATENT DOCUMENTS

| | | | |
|---|---|---|---|
| 722536 | 12/1931 | France | 292/247 |

*Primary Examiner*—Richard E. Moore

*Attorney, Agent, or Firm*—Bean, Kauffman & Bean

[57] ABSTRACT

The improvement in a hood latch mechanism of the type including an operating handle connected by a hinge pin to a spring biased yoke and mounting a latching pin engageable with a keeper to releasably retain the mechanism in latched condition, which features the utilization of the hinge pin in cooperation with the keeper to create an auxiliary latching device for maintaining the mechanism in its over center latched position even under severe road conditions.

5 Claims, 4 Drawing Figures

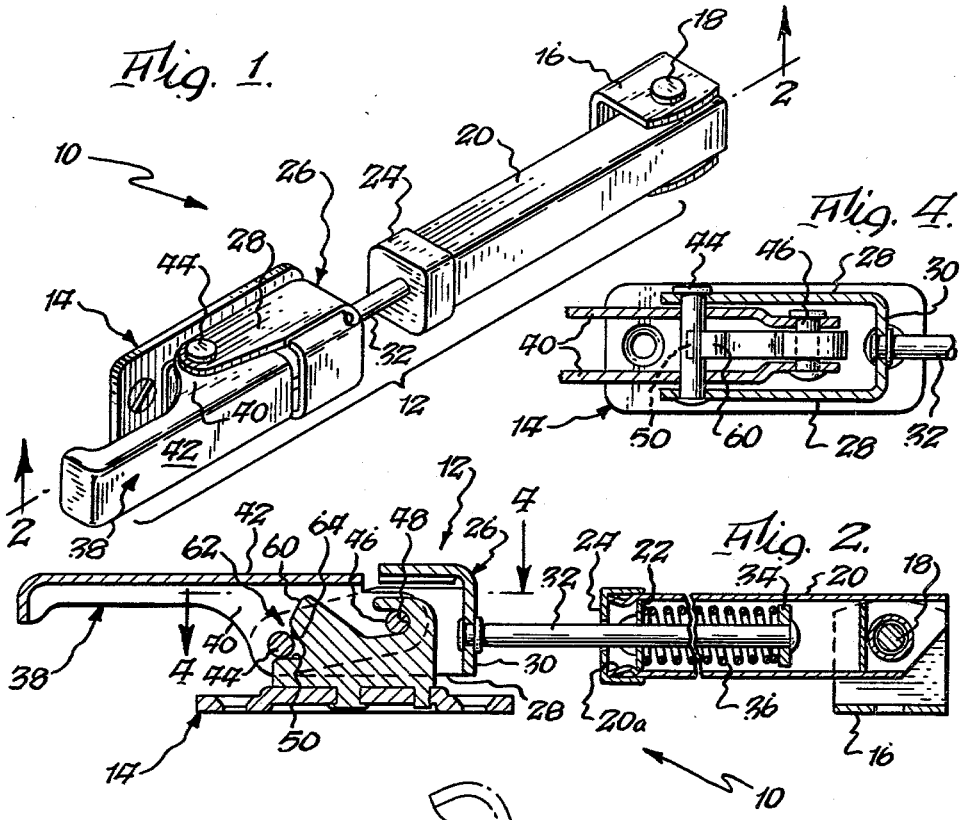
Fig. 1.
Fig. 4.
Fig. 2.
10
12
14
16
18
20
20a
22
24
26
28
30
32
34
36
38
40
42
44
46
48
50
60
62
64
2
4
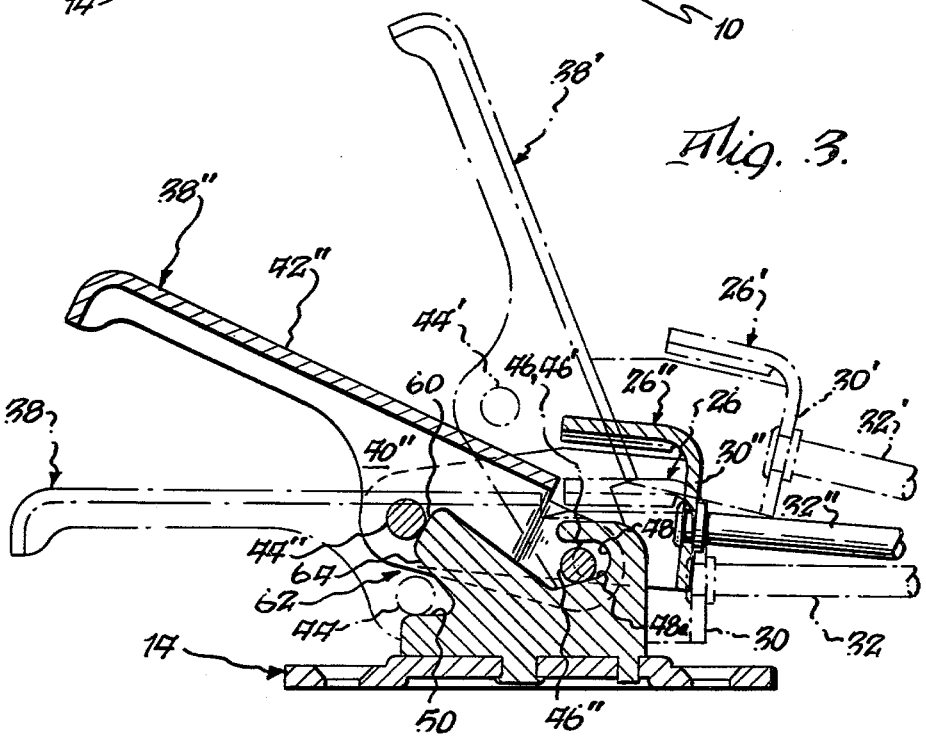
Fig. 3.
38'
38"
38
42"
44'
44"
44
46,46'
46"
48
48a
50
60
62
64
26'
26"
26
30'
30"
30
32'
32"
32
40"
14

HOOD LATCH

BACKGROUND OF THE INVENTION

Prior hood latches of which I am aware, are generally illustrated by the following U.S. patents:

| Patent No. | Issue Date |
|---|---|
| 1,382,322 | June 21, 1921 |
| 1,400,953 | Dec. 20, 1921 |
| 1,456,396 | May 22, 1923 |
| 1,570,621 | Jan. 26, 1926 |
| 3,618,995 | Nov. 9, 1971 |
| 3,628,817 | Dec. 21, 1971 |
| 3,985,380 | Oct. 12, 1976 |

The most typical prior hood latch constructions would appear to be that disclosed by U.S. Pat. Nos. 1,400,953; 1,456,396 and 1,570,621, wherein an operating handle is connected by a hinge pin to a spring biased yoke and has one of its ends shaped to define a pivot member sized for receipt within a recess defined by a keeper. Upon placement of the pivot member of the handle in the keeper recess, the handle may be swung over-center into a latched position maintained by the spring bias supplied to the yoke.

A decided disadvantage of the above described hood latch construction is that relative movement between a latched hood or closure panel and vehicle body structure could result in sufficient release or reduction of spring tension, as would result in unintended unlatching of the hood. As a result, it has been common practice to provide hood latches of the above described type with relatively high spring tension operating forces, which is disadvantageous from the standpoint of the degree of operator's strength required to operate the latch.

More recently, attempts have been made to devise hood latches having auxiliary latching arrangements intended to prevent unintended unlatching of the hood, as evidenced by U.S. Pat. Nos. 3,618,995; 3,628,817 and 3,985,380. However, the auxiliary latching devices contemplated by these patents are believed to unduly complicate their construction.

SUMMARY OF THE INVENTION

The present invention is directed to an improvement in hood latch mechanisms of the general type disclosed by the above discussed patents, which features the utilization of the hinge pin and keeper to provide an auxiliary latching device for maintaining the mechanism in its over-center latched condition without need for employing excessive spring operating pressures.

DRAWINGS

The nature and mode of operation of the present invention will now be more fully described in the following detailed description taken with the accompanying drawings wherein:

FIG. 1 is a perspective view of the hood latch formed in accordance with the present invention showing same in latched or closed condition;

FIG. 2 is a sectional view taken generally along the line 2—2 in FIG. 1;

FIG. 3 is an enlarged sectional view similar to FIG. 2, but showing steps in the movement of the hood latch into its latched condition; and FIG. 4 is a sectional view taken generally along the line 4—4 in FIG. 2.

DETAILED DESCRIPTION

Reference is now made primarily to FIGS. 1 and 2, wherein a hood latch formed in accordance with the present invention is generally designated as 10 and shown as including a latch assembly 12 adapted for mounting on a vehicle body panel, not shown, for engagement with a keeper 14 adapted for mounting on a hood or other closure panel, also not shown. Although the latch of the present invention is described with particular reference to its use as a vehicle hood latch, it is anticipated that such latch may be used in other environments to retain panels, door or like elements in a relatively latched or closed condition.

Latch assembly 12 includes a suitable pivot mounting device, such as may be defined by a generally U-shaped mounting bracket 16 apertured to receive a hinge pin 18; a barrel member 20 having one end apertured to receive hinge pin 18 and an opposite end formed with suitable means, such as dimples 20*a*, serving to position a first bearing washer 22 and provide for snap fit mounting of an apertured closure cap 24; a generally U-shaped yoke or bracket member 26 having a pair of leg flanges 28 connected by a base flange 30; an elongated tension bolt 32 projecting through washer 22 and cap 24 for opposite end attachment to a second bearing washer 34 and bracket base flange 30; a resiliently deformable member, such as may be defined by a coil type compression spring 36 disposed concentrically of bolt 32 for opposite end bearing engagement with washers 22 and 34; and a generally U-shaped operating handle 38 having a pair of leg flanges 40 connected by a base flange 42. Handle 38 is hingedly connected to bracket 26, as by a hinge pin 44 received within aligned openings of leg flanges 28 and 40, as best shown in FIG. 4, and additionally carries at one of its ends a suitable pivot member or latching device, such as may be defined by a leg flange support latch pin 46, arranged to removably seat within a latch recess 48 defined by keeper 14.

As will be apparent, when latch pin 46 is seated within recess 48, handle 38 may be swung relative to bracket 26 into a latched position, shown in FIG. 2 and determined for example by engagement of some portion of handle 38 or hinge pin 44 with a suitable abutment, such as may be defined by keeper stop surface or ledge 50. In latched position, the force established by spring 36 tends to retain the axis of hinge pin 44 and the axis of bolt 32 over-center relative to the axis of latch pin 46.

The portions of latch assembly 12 and keeper 14, as thus far generally described, are conventional and not intended as limiting as to the structure of the present invention. For example, while the drawings illustrate a latch assembly fitted with a separately fabricated barrel, bolt, compression spring and yoke, it is contemplated that the present invention may be practiced with any suitable resiliently deformable tension means hingedly connected to an operating handle and operable to provide a resilient bias for releasably retaining a pivot member carried by the handle in latching engagement within a latching recess defined by a keeper, such as for instance that provided by a resiliently deformable tension member of the type generally described in U.S. Pat. Nos. 3,618,995 and 3,985,380.

In accordance with the present invention, keeper 14 is additionally provided with a downwardly and rearwardly inclined cam surface 60 leading to an auxiliary recess 62 bounded by a downwardly and forwardly inclined auxiliary latching or second cam surface 64 and stop surface 50. The adjacently disposed and converging cam and latching surfaces cooperate with hinge pin 44 to provide an auxiliary latching mechanism serving to releasably retain latch 10 in its latched condition in the manner to be described. It will be understood that such terms as "downwardly", "rearwardly" and "forwardly" are used solely in reference to the positions of surfaces 60 and 64 relative to latch recess 48 and latch pin 46, as viewed in FIG. 2, and are not meant to be limiting, since latch 10 might normally be installed in an orientation other than that specifically illustrated. It will also be understood that the illustrated shapes of surfaces 60 and 64, as well as the radius of curvature of their "apex", may be departed from and/or hinge pin 44 formed with a bearing sleeve or the like, as required to accommodate for desired operating characteristics of the auxiliary latching mechanism. Further, if desired, the construction of handle 38 and keeper 14 may be reversed, such that the keeper is of bifurcated design and its cam surfaces are arranged to engage opposite ends of the hinge pin or bearing extensions thereof.

Reference is now made specifically to FIG. 3 for its showing of successive steps in the movement of latch 10 into its latched position. To facilitate reference to the drawing, the elements of the latch assembly are designated by non-primed numerals when in their latched position shown in broken line and described above in reference to FIG. 2; by primed numerals when in their unlatched position also shown in broken line; and by double primed numerals when in their intermediate position shown in full line. In the illustrated unlatched position, latch pin 46' is simply seated within recess 48 and handle 38' occupies a pivotal position relative to yoke 26' such that compression of spring 36 may be initiated upon operator manipulated counterclockwise swinging movement of the handle, as viewed in FIG. 3. Alternatively, clockwise pivotal movements of handle 38' relative to yoke 26' will serve to remove latch pin 46' from within recess 48 to effect complete separation of latch assembly 12 from keeper 14, when desired to permit opening of the vehicle hood.

With latch pin 46' seated in recess 48, swinging movement of handle 38' relative to yoke 26' in a counterclockwise direction serves to move the yoke and thus rod 32' downwardly and to the left, as viewed in FIG. 3, and this in turn serves to progressively compress spring 36. Incident to continued movement of the handle into its intermediate full line position, the hinge pin is placed in engagement with cam surface 60. As best shown in FIG. 3, the distance between adjacent portions of surfaces 60 and 64 and the bottom or closed bearing end of latch recess 48 exceeds the distance between the operative bearing surfaces of the hinge and latch pins. Thus, as the hinge pin is moved downwardly along and in bearing engagement with cam surface 60 into its intermediate position designated at 44'', the latch pin is unseated or displaced from bearing engagement with the closed end of recess 48 and moved into its intermediate position designated at 46''. Otherwise stated, movement of the hinge pin downwardly along cam surface 60 serves to move handle 38'', yoke 26'' and rod 32'' to the left, as viewed in FIG. 3, and thereby effect compression of spring 36 to an extent greater than that obtainable by simple over-center pivotal movements of the handle about the pivot pin when fully seated in recess 48.

Upon continued swinging movement of handle 38'' relative to yoke 26'', hinge pin 44'' rides off the lower end of cam surface 60 into recess 62, whereupon spring 36 is freed to partially expand and thereby bias or automatically effect final movement of the elements of the latch assembly into their fully latched positions. Incident to such final movement, latch pin 46 is returned to fully seated or bearing engagement with the closed end of recess 48 and hinge pin 44 is disposed in engagement with stop surface 50. Preferably, the construction is such that the hinge pin passes over-center while engaged with either the lower end of cam surface 60 or the "apex" portion defined by the juncture of surfaces 60 and 64.

To return the latch assembly to its unlatched position, it is necessary for an operator to pull upwardly on handle 38 using pivot pin 46 as a fulcrum bearing first on the closed end of recess 48 and then on its lower boundary surface **48*a* as hinge pin 44 is forced to slide upwardly along latching surface 64 against the bias of spring 36. After handle 38 has been swung sufficiently to place the hinge pin in engagement with the lower end of cam surface 60 and thereby move the hinge pin over-center relative to the pivot pin, spring force tends to bias the latch assembly towards its unlatched condition, shown in FIG. 3**.

As in the case of prior hood latch constructions, the bias established by spring 36 tends to oppose unlatching over-center movements of hinge pin 44, which might unintentionally remove pivot pin 46 from latching engagement with keeper 14. However, it will be appreciated that when the spring of a conventional hood latch momentarily experiences a substantial relaxation, due to severe road conditions, even a slight transversely directed vibration will likely cause that limited degree of pivotal movement of the hinge pin about the axis of the pivot pin required to permit same to pass over-center. By comparison, the present hood latch is immune from such transverse vibrations, since over-center swinging movements of hinge pin 44 about the axis of pivot pin 46 when seated within recess 48 is constrained by engagement of the hinge pin with latching surface 64. While it is possible to effect controlled unlatching movements of the latch assembly upon operator manipulation of handle 38 in the manner described above, it should again be noted that sliding or camming movements of the hinge pin upwardly along surface 64 is accompanied by an increase in the state of compression of spring 36 beyond that which it normally assumes in latched condition. This required change or increase in spring force is thus available for use in preventing unintended movement of the hinge pin from within the confines of recess 62 under severe road conditions.

I claim:

1. In a latch of the type employing the over-center latching principal and comprising a keeper having a latch recess and a latch assembly having resiliently deformable tension means connected by a hinge pin to an operating handle carrying a pivot member, said pivot member being releasably seated for bearing engagement within an end of said latching recess for latching purposes by bias established by said tension means incident to over-central travel of said hinge pin relative to said pivot member into a latched position, the improvement comprising in combination:

means cooperating with said hinge pin for providing an auxiliary latch releasably constraining said hinge pin from travel over-center away from said latched position.

2. The improvement according to claim 1, wherein said means is arranged for bearing engagement with said hinge pin and operable to temporarily remove said pivot member from full seated engagement with said end of said latching recess against said bias established by said tension means incident to travel of said hinge pin over-center towards and away from said latched position.

3. The improvement according to claim 1, wherein said means includes adjacently disposed cam and latching surfaces arranged for bearing engagement with said hinge pin incident to travel thereof over-center towards and away from said latching positions, respectively, and portions of said surfaces at least adjacent the juncture thereof are spaced from said end of said latching recess through a distance exceeding the distance between operative bearing surfaces of said hinge pin and said pivot member.

4. The improvement according to claim 1, wherein said means includes adjacently disposed cam and latching surfaces defined by said keeper and converging in a direction away from said end of said latching recess, said cam latching surfaces being arranged for bearing engagement with said hinge pin incident to travel thereof over-center towards and away from said latching position, respectively, said cam and latching surfaces having adjacent portions thereof spaced from said end sufficiently to remove said pivot member from full seated engagement with said end against the bias established by said tension means incident to travel of said hinge pin over-center towards and away from said latched position.

5. The improvement according to claim 4, wherein said hinge pin passes over-center while engaged with said cam surface immediately adjacent the juncture thereof with said latching surface.

* * * * *